US007710340B2

(12) United States Patent
Rao et al.

(10) Patent No.: US 7,710,340 B2
(45) Date of Patent: May 4, 2010

(54) RECONFIGURABLE PAYLOAD USING NON-FOCUSED REFLECTOR ANTENNA FOR HIEO AND GEO SATELLITES

(75) Inventors: Sudhakar K. Rao, Churchville, PA (US); Stephen R. Peck, Yardley, PA (US); Minh Tang, Yardley, PA (US); Jim Wang, Churchville, PA (US); David M. Brown, Upper Makefield, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 350 days.

(21) Appl. No.: 11/480,497

(22) Filed: Jul. 5, 2006

(65) Prior Publication Data

US 2007/0182654 A1 Aug. 9, 2007

Related U.S. Application Data

(60) Provisional application No. 60/758,674, filed on Jan. 13, 2006.

(51) Int. Cl.
*H01Q 13/00* (2006.01)

(52) U.S. Cl. ..... 343/781 R; 343/778; 343/779

(58) Field of Classification Search ..... 343/779, 343/781, 778, 757, 758, 761, 753–755, 878, 343/879, 882, 772, 775, 781 R, 781 P, 781 CA, 343/786, 912

See application file for complete search history.

(56) References Cited

U.S. PATENT DOCUMENTS

| | | | | |
|---|---|---|---|---|
| 5,422,595 | A * | 6/1995 | Lott | 330/2 |
| 5,936,588 | A | 8/1999 | Rao et al. | |
| 5,936,592 | A * | 8/1999 | Ramanujam et al. | 343/853 |
| 6,456,252 | B1 * | 9/2002 | Goyette | 343/779 |
| 7,075,495 | B2 * | 7/2006 | Jung et al. | 343/779 |
| 2004/0189538 | A1 * | 9/2004 | Rao et al. | 343/757 |

* cited by examiner

*Primary Examiner*—Hoang V Nguyen
*Assistant Examiner*—Robert Karacsony
(74) *Attorney, Agent, or Firm*—McDermott Will & Emery LLP

(57) ABSTRACT

An antenna system for generating and configuring at least one defocused beam is provided. The antenna system includes a reflector having a focal plane and a non-parabolic curvature for forming the at least one defocused beam, and a plurality of feed antennas that illuminate the reflector. Each feed antenna is disposed in the focal plane of the reflector. The antenna system further includes at least one incoming signal dividing network that divides at least one incoming signal into a plurality of sub-signals, each corresponding to one of the feed antennas, a plurality of variable phase shifters, each receiving one of the sub-signals from the incoming signal dividing network and phase shifting the sub-signal to generate a corresponding phase-shifted sub-signal, and a plurality of fixed-amplitude amplifiers, at least one corresponding to each of the feed antennas. The at least one amplifier for each feed antenna amplifies the corresponding phase-shifted sub-signal to generate an amplified phase-shifted sub-signal which is provided to the corresponding feed antenna.

18 Claims, 17 Drawing Sheets

RECONFIGURABLE PAYLOAD USING NON-FOCUSED REFLECTOR ANTENNA FOR HIEO AND GEO SATELLITES

CROSS-REFERENCE TO RELATED APPLICATION

The present application claims the benefit of priority under 35 U.S.C. §119 from U.S. Provisional Patent Application Ser. No. 60/758,674 entitled "RECONFIGURABLE PAYLOAD USING NON-FOCUSED REFLECTOR ANTENNA FOR HIEO AND GEO SATELLITES," filed on Jan. 13, 2006, the disclosure of which is hereby incorporated by reference in its entirety for all purposes.

STATEMENT REGARDING FEDERALLY SPONSORED RESEARCH OR DEVELOPMENT

Not applicable.

FIELD OF THE INVENTION

The present invention generally relates to spacecraft payloads and, in particular, relates to reconfigurable payloads for highly inclined elliptical orbit (HIEO) and geostationary orbit (GEO) communication satellites.

BACKGROUND OF THE INVENTION

Satellites with reconfigurable payloads provide desirable on-orbit mission flexibility. A reconfigurable payload allows a satellite to change the shape and location of its beams in order to change earth coverage regions. These changes may be necessary in order to compensate for spacecraft yaw steering, to back up or replace another satellite in-orbit, or as a result of changing market demands or customer requirements.

One approach to providing a reconfigurable payload involves using a Gregorian reflector antenna with an elliptical sub-reflector in order to produce a very broad elliptical beam. By rotating the elliptical sub-reflector, the far-field beam can be rotated to compensate for the yaw rotation of the satellite. This approach suffers from reliability problems because the reconfiguration is mechanical. Moreover, the gain of such an antenna is insufficient for many applications.

Another approach to providing a reconfigurable payload uses phased array optics to illuminate a reflector. In this approach, several hundred optical elements are used to provide the required phase delay between elements. Because of the large number of elements, this approach suffers from increased mass and expense. Moreover, this approach is unsuitable for handling large power loads due to the fact that the large number of amplifiers required can not be accommodated on a spacecraft. Other limitations include the difficulty of power dissipation and very high cost.

Yet another approach uses a system in which a feed array is located out of the focal plane of a parabolic reflector to defocus the beam. This approach provides limited or no beam reconfiguration. Further, because the basic reflector geometry is de-optimized, the system suffers from increased scan losses, inferior cross-polar performance, mutual coupling effects and the like. Moreover, the number of optical and other elements required is still undesirably large, and the system requires complex input and output hybrid matrices.

Accordingly, there is a need for a flexible, reconfigurable payload with less complexity, more beam configurability, better reliability, and higher performance. The present invention satisfies these needs, and provides other benefits as well.

SUMMARY OF THE INVENTION

In accordance with the present invention, an antenna system having improved on-orbit beam configurability is provided. The antenna system includes a plurality of feed antennas located in the focal plane of a non-parabolic reflector that illuminate the reflector to form one or more defocused beams. The configurability is provided by changing the relative phase distribution among the feed antennas, which is accomplished at a low-level (i.e., prior to amplification). One or more incoming signals are divided in one or more corresponding dividing networks and are provided to a plurality of variable phase shifters, each of which corresponds to one of the feed antennas. After phase shifting, the signals are amplified by a plurality of fixed-amplitude amplifiers and provided to the feed antennas.

According to one embodiment, the present invention is an antenna system for generating and configuring at least one defocused beam. The antenna system includes a reflector having a focal plane and a non-parabolic curvature that forms the at least one defocused beam and a plurality of feed antennas that illuminate the reflector. Each feed antenna is disposed in the focal plane of the reflector. The antenna system further includes at least one incoming signal dividing network that divides at least one incoming signal into a plurality of sub-signals. Each sub-signal corresponds to one of the plurality of feed antennas. The antenna system further includes a plurality of variable phase shifters, each variable phase shifter receiving one of the plurality of sub-signals from the at least one incoming signal dividing network and phase shifting the one of the plurality of sub-signals to generate a corresponding phase-shifted sub-signal. The antenna system further includes a plurality of fixed-amplitude amplifiers, at least one amplifier corresponding to each of the plurality of feed antennas. The at least one amplifier for each feed antenna amplifies the corresponding phase-shifted sub-signal to generate an amplified phase-shifted sub-signal which is provided to the corresponding feed antenna.

According to another embodiment, the present invention is a method for generating and configuring at least one defocused beam using an antenna system including a reflector having a non-parabolic curvature and a plurality of feed antennas disposed in a focal plane of the reflector. The method includes the step of dividing at least one incoming signal with at least one incoming signal dividing network into a plurality of sub-signals, each sub-signal corresponding to one of the plurality of feed antennas. The method further includes the step of phase shifting the plurality of sub-signals with a plurality of variable phase shifters, each variable phase shifter receiving one of the plurality of sub-signals from the at least one incoming signal dividing network and phase shifting the one of the plurality of sub-signals to generate a corresponding phase-shifted sub-signal. The method further includes the step of amplifying the plurality of phase-shifted sub-signals with a plurality of fixed-amplitude amplifiers, at least one amplifier corresponding to each of the plurality of feed antennas. The at least one amplifier for each feed antenna amplifies a corresponding phase-shifted sub-signal to generate an amplified phase-shifted sub-signal which is provided to the corresponding feed antenna. The method further includes the step of illuminating the reflector with the plurality of feed antennas to generate the at least one defocused beam.

According to yet another embodiment, the present invention is a method for generating and configuring at least one defocused beam using an antenna system including a reflector having non-parabolic curvature and a plurality of feed antennas disposed in a focal plane of the reflector, the reflector including a single-axis gimbal mechanism. The method includes the step of dividing at least one incoming signal with at least one incoming signal dividing network into a plurality of sub-signals, each sub-signal corresponding to one of the plurality of feed antennas. The method further includes the step of phase shifting the plurality of sub-signals with a plurality of variable phase shifters, each variable phase shifter receiving one of the plurality of sub-signals from the at least one incoming signal dividing network and phase shifting the one of the plurality of sub-signals to generate a corresponding phase-shifted sub-signal. The method further includes the step of amplifying the plurality of phase-shifted sub-signals with a plurality of fixed-amplitude amplifiers, at least one amplifier corresponding to each of the plurality of feed antennas. The at least one amplifier for each feed antenna amplifies a corresponding phase-shifted sub-signal to generate an amplified phase-shifted sub-signal which is provided to the corresponding feed antenna. The method further includes the step of illuminating the reflector with the plurality of feed antennas to generate the at least one defocused beam. The plurality of variable phase shifters phase shift the plurality of sub-signals to compensate for a yawing motion of the antenna system. The single-axis gimbal mechanism of the reflector gimbals the reflector to compensate for a rolling motion of the antenna system.

It is to be understood that both the foregoing summary of the invention and the following detailed description are exemplary and explanatory and are intended to provide further explanation of the invention as claimed.

BRIEF DESCRIPTION OF THE DRAWINGS

The accompanying drawings, which are included to provide further understanding of the invention and are incorporated in and constitute a part of this specification, illustrate embodiments of the invention and together with the description serve to explain the principles of the invention. In the drawings.

DETAILED DESCRIPTION OF THE INVENTION

In the following detailed description, numerous specific details are set forth to provide a full understanding of the present invention. It will be apparent, however, to one ordinarily skilled in the art that the present invention may be practiced without some of these specific details. In other instances, well-known structures and techniques have not been shown in detail to avoid unnecessarily obscuring the present invention.

Figure 1:
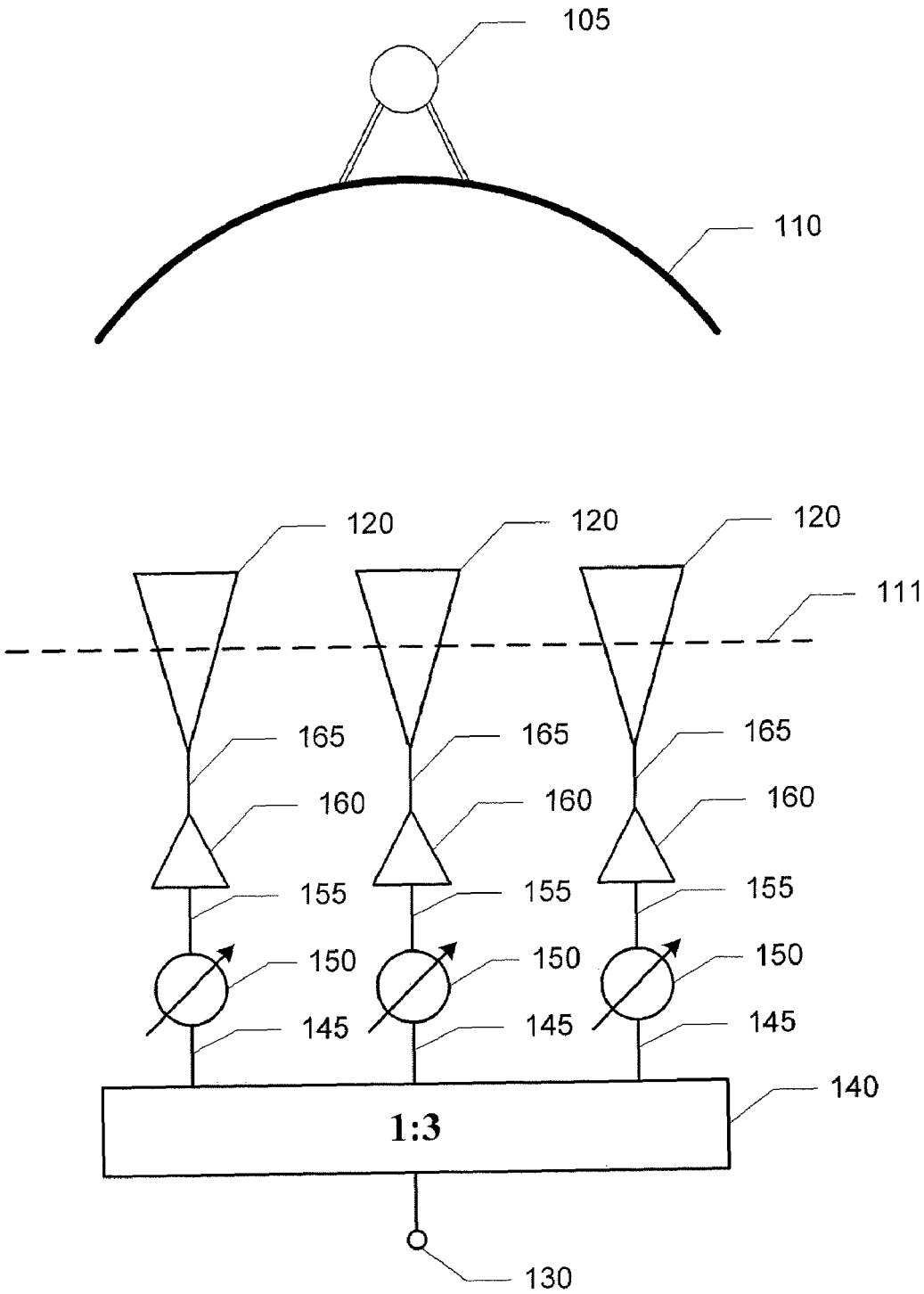
FIG. 1 depicts an antenna system according to one embodiment of the present invention.

FIG. 1 illustrates an antenna system for generating and configuring at least one defocused beam according to one embodiment of the present invention. Antenna system 100 includes a reflector 110 having a non-parabolic curvature for forming one or more defocused beams. A plurality of feed antennas 120 are disposed in the focal plane 111 of reflector 110. The feed antennas 120 illuminate reflector 110 to generate the one or more defocused beams in the following manner.

An incoming signal 130 is divided by an incoming signal dividing network 140 into a plurality of sub-signals 145. Each sub signal 145 corresponds to one of the feed antennas 120. Each sub-signal 145 is received from incoming signal dividing network 140 by a variable phase shifter 150 which phase shifts sub-signal 145 to generate a corresponding phase-shifted sub-signal 155. A corresponding fixed-amplitude amplifier 160 amplifies each phase-shifted sub-signal 155 to generate an amplified phase-shifted sub-signal 165 which is provided to the corresponding feed antenna 120. Feed antennas 120 together illuminate reflector 110 with amplified phase-shifted sub-signals 165 to generate the one or more defocused beams.

Amplifiers 160 are fixed-amplitude amplifiers. Accordingly, the configuration of the one or more beams is accomplished with phase-only synthesis, as is discussed in greater detail below. The use of fixed-amplitude amplifiers allows antenna system 100 to operate close to saturation with maximum DC-to-RF conversion efficiency (e.g., about 60% efficiency). According to one embodiment, amplifiers 160 are traveling wave tube amplifiers ("TWTAs"). According to an alternate embodiment, amplifiers 160 may be solid state power amplifiers ("SSPAs") or any other fixed-amplitude amplifiers.

Reflector 110 has a non-parabolic curvature to form one or more defocused beams. According to one embodiment of the present invention, the curvature of reflector 110 is optimized to minimize the number of elements (e.g., amplifiers, feed antennas, etc.) in the feed array and to efficiently combine the individual beamlets (i.e., the signals from each feed antenna 120). For example, according to one embodiment, the curvature of reflector 110 is selected so that the resultant beam has a quadratic phase distribution in the aperture plane of reflector 110. This curvature broadens the one or more defocused beams to about 2 to 3 times the breadth that would be generated by a parabolic reflector, thereby reducing the required number of feed array elements by a factor of 4, as is discussed in greater detail below with respect to FIG. 4.

According to one embodiment, reflector 110 is a 12 meter mesh reflector. According to other embodiments, reflector 110 may be any other size, and may be any other kind of reflector known to those of skill in the art. According to one embodiment, reflector 110 may include a single-axis gimbal mechanism 105 to provide ground track compensation for the rolling motion of a satellite vehicle on which antenna system 100 is deployed.

According to one embodiment, variable phase shifters 150 are 8-bit phase shifters with the ability to adjust the phase of a signal in increments of 1.4°. According to other embodiments, variable phase shifters 150 may be any kind of phase shifter known to those of skill in the art. Post-amplification signal losses are kept low by phase shifting the sub-signals 145 with variable phase shifters 150 prior to amplification.

While in the exemplary embodiment illustrated in FIG. 1, incoming signal dividing network 140 is illustrated as a 1:3 network (i.e., dividing incoming signal 130 into three sub-signals 145), the scope of the present invention is not limited to such an arrangement. Rather, an incoming signal dividing network of the present invention may divide an incoming signal into any number of sub-signals, corresponding to the number of feed antennas, as will be apparent to one of skill in the art. For example, in an embodiment in which the antenna system has 37 feed antennas, an incoming signal dividing network of the present invention will divide an incoming signal into 37 sub-signals.

The amplification in antenna system 100 is distributed by providing feed antennas 120 with corresponding amplifiers 160. This distributed amplification mitigates the risk of multipaction. While in the present exemplary embodiment illustrated in FIG. 1, one amplifier 160 corresponds to each feed antenna 120, the scope of the present invention is not limited to such an arrangement. Rather, as will be apparent to one of skill in the art, an antenna system of the present invention may have more than one amplifier corresponding to each feed antenna, as is illustrated in greater detail with respect to FIG. 2.

Figure 2:
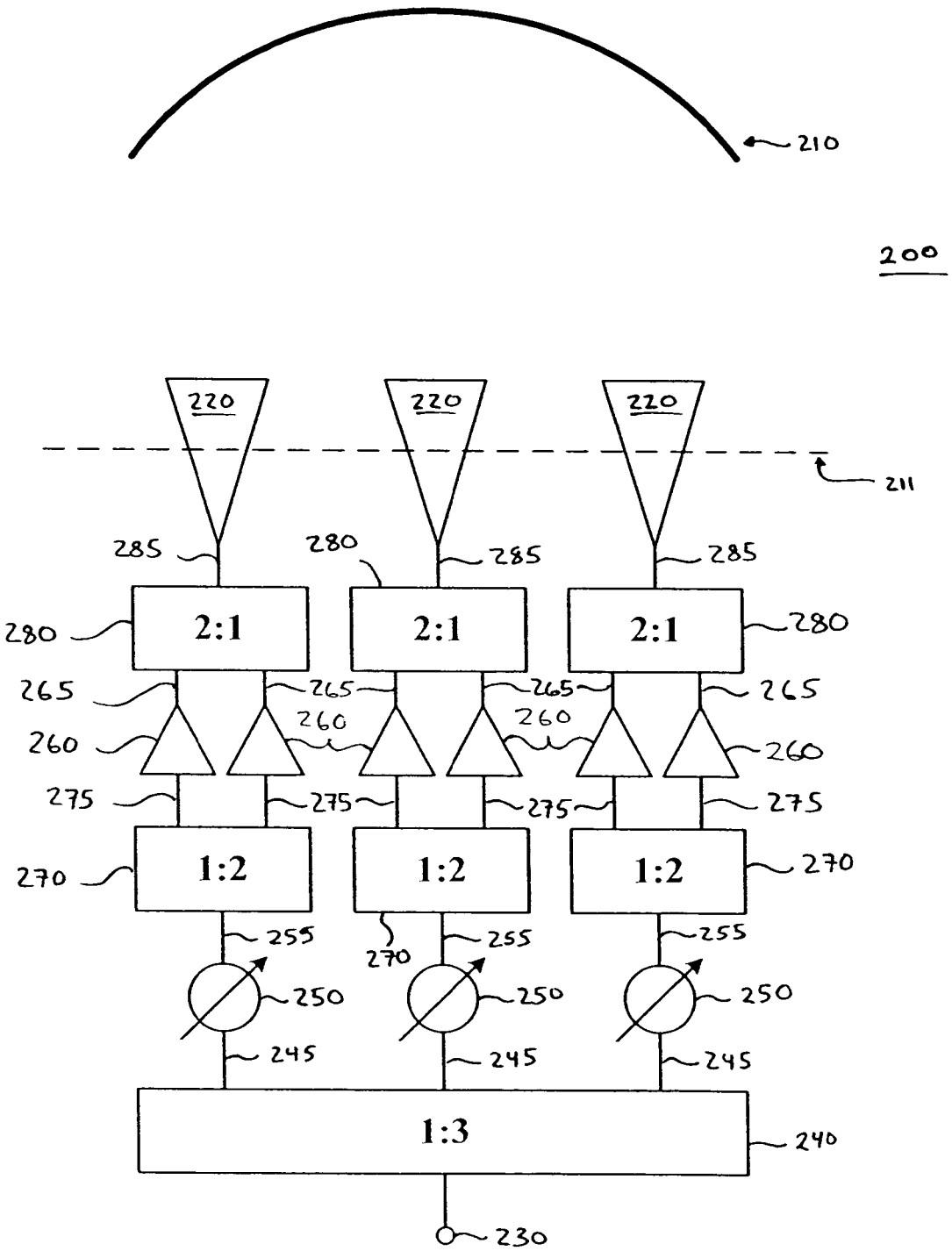
FIG. 2 depicts an antenna system according to another embodiment of the present invention.

Turning to FIG. 2, an antenna system according to another embodiment of the present invention is illustrated. Antenna system 200 includes a reflector 210 having a non-parabolic curvature for forming one or more defocused beams. A plurality of feed antennas 220 are disposed in the focal plane 211 of reflector 210. The feed antennas 220 illuminate reflector 210 to generate the one or more defocused beams in the following manner.

An incoming signal 230 is divided by an incoming signal dividing network 240 into a plurality of sub-signals 245. Each sub signal 245 corresponds to one of the feed antennas 220. Each sub-signal 245 is received from incoming signal dividing network 240 by a variable phase shifter 250 which phase shifts sub-signal 245 to generate a corresponding phase-shifted sub-signal 255. A corresponding pre-amp dividing network 270 divides each phase-shifted sub-signal 255 to generate a plurality of divided phase-shifted sub-signals 275. Each divided phase-shifted sub-signal 275 is provided to a corresponding fixed-amplitude amplifier 260. Each amplifier 260 amplifies the corresponding divided phase-shifted sub-signal 275 to generate an amplified divided phase-shifted sub-signal 265. Corresponding to each pre-amp dividing network 270 is a combining network 280, which receives the amplified divided phase-shifted sub-signals 265 from each amplifier in a group of amplifiers corresponding to one feed antenna 220 and combines them to generate a corresponding amplified phase-shifted sub-signal 285, which is provided to the corresponding feed antenna 220. Feed antennas 220 together illuminate reflector 210 with amplified phase-shifted sub-signals 285 to the generate the one or more defocused beams.

According to one aspect of the present invention, the RF power of an antenna system of the present invention depends upon the number of feed antennas provided and the number of amplifiers associated with each feed antenna. Accordingly, Table 1, below, illustrates various arrangements in which the number of feed antennas and the number of amplifiers associated with each feed antenna are varied to provide a different levels of RF power. For the purposes of the present exemplary embodiment of Table 1, each amplifier is assumed to be a 230 W TWTA.

TABLE 1

| # of Feeds | # Amps/Feed | RF Power | DC Power |
|---|---|---|---|
| 32 | 1 | 7,360 | 12,475 |
| 16 | 2 | 7,360 | 12,475 |
| 37 | 1 | 8,510 | 14,424 |
| 20 | 2 | 9,200 | 15,593 |
| 48 | 1 | 1,1040 | 18,712 |

In the exemplary embodiment illustrated in FIG. 2, each feed antenna 220 has two corresponding fixed-amplitude amplifiers 260. The scope of the present invention, however, is not limited to such an arrangement. Rather, as will be apparent to one of skill in the art, the present invention has application to antenna systems in which any number of amplifiers corresponds to each feed antenna, including arrangements in which different numbers of amplifiers correspond to different feed antennas.

Figure 3A:
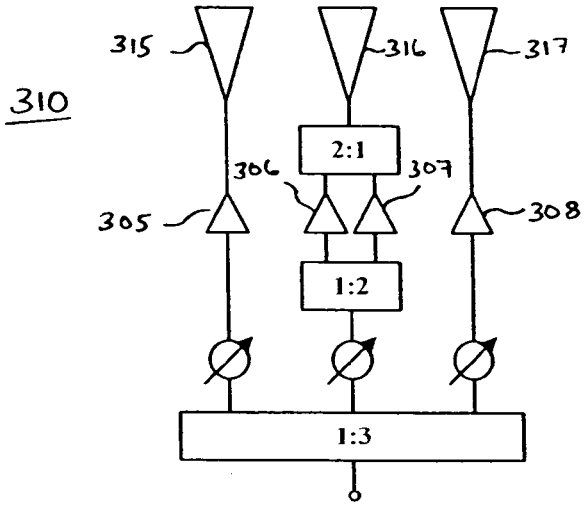
FIGS. 3A to 3C illustrate feed arrays according to various aspects of the present invention.

For example, FIG. 3A illustrates a feed array 310 according to one aspect of the present invention in which one feed antenna 316 corresponds to two fixed-amplitude amplifiers 306 and 307, while other feed antennas 315 and 317 each correspond to one fixed-amplitude amplifier 305 and 308, respectively. If each amplifier 305, 306, 307 and 308 have the same amplitude, feed antenna 316 will provide a beamlet with twice the amplitude of feed antennas 315 and 317.

Figure 3B:
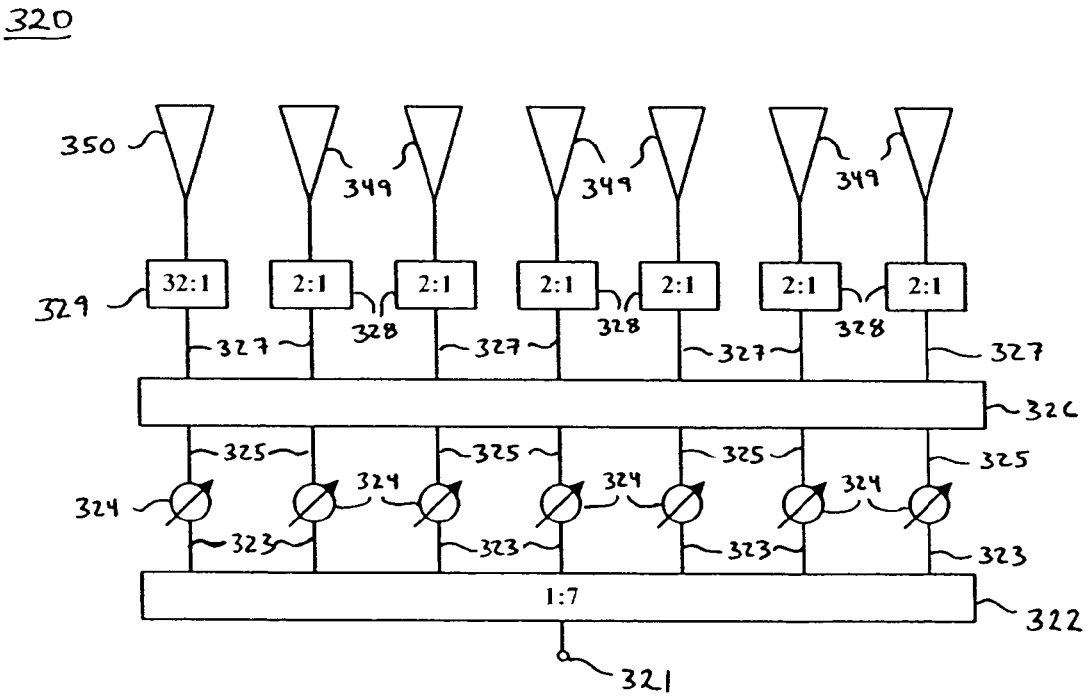

FIG. 3B illustrates a feed array 320 according to another aspect of the present invention, in which fixed-amplitude amplifiers do not correspond to particular feed antennas. An incoming signal 321 is divided by an incoming signal dividing network 322 into a plurality of sub-signals 323. Each sub signal 323 corresponds to one of the feed antennas 349 and 350. Each sub-signal 323 is received from incoming signal dividing network 322 by a variable phase shifter 324 which phase shifts sub-signal 323 to generate a corresponding phase-shifted sub-signal 325. A redundancy ring with a plurality of fixed-amplitude amplifiers 326 amplifies phase-shifted sub-signals 325 and passes the amplified phase-shifted sub-signals 327 to couplers 328 and 329. In the present exemplary embodiment, each coupler 328 is a 2:1 coupler, while coupler 329 is a 32:1 coupler. Accordingly, feed antenna 350 will provide a beamlet with 16 times the amplitude of any of feed antennas 349.

Figure 3C:
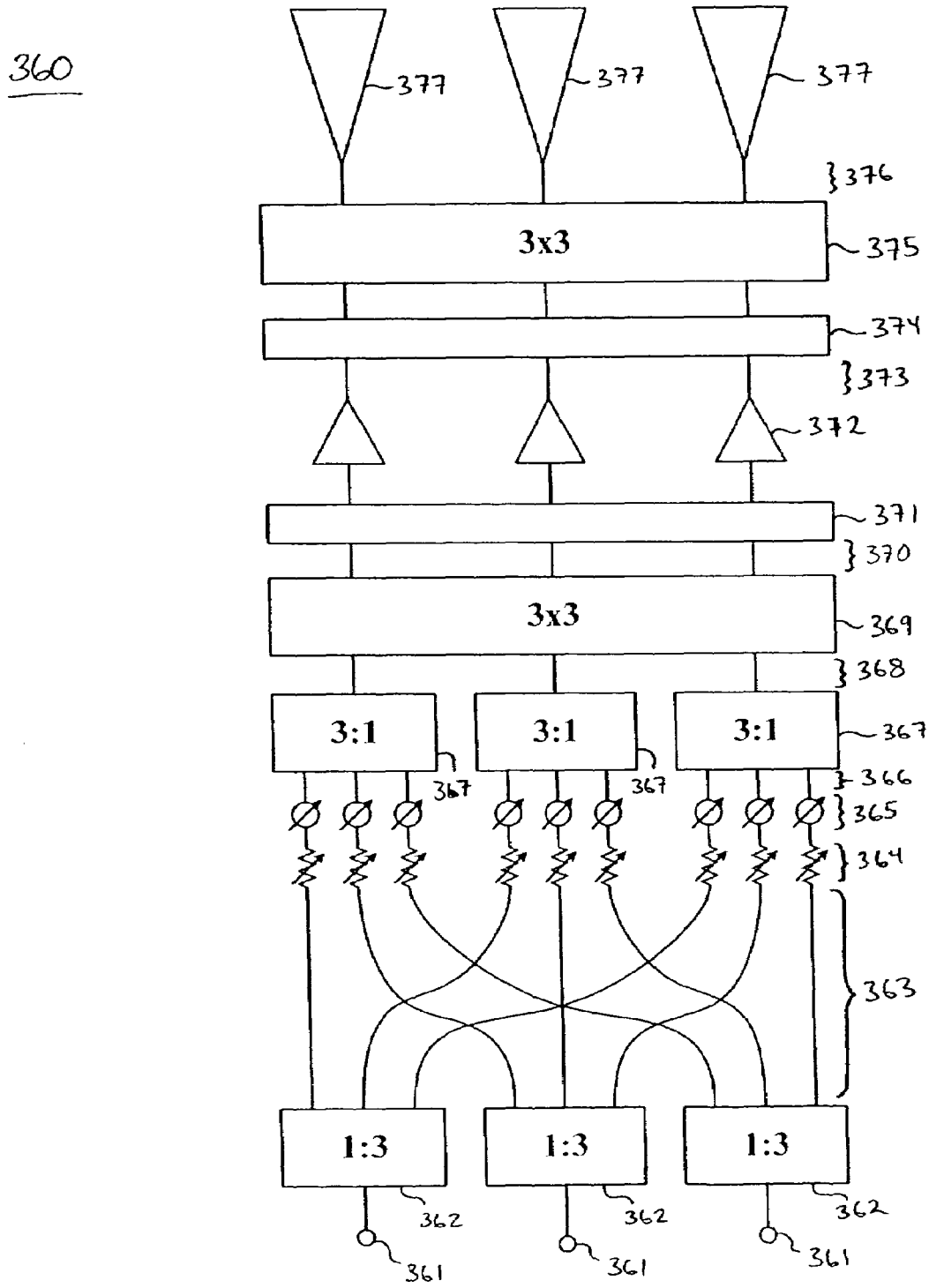

FIG. 3C illustrates a feed array 360 according to another aspect of the present invention, in which multiple incoming signals are provided to generate multiple beams. Each incoming signal 361 is divided by a corresponding incoming signal dividing network 362 to generate a corresponding plurality of sub-signals 363. Each sub signal 363 generated by a single incoming signal dividing network corresponds to one of the feed antennas 377. Each sub signal 363 is received from one of the incoming signal dividing networks 362 by a variable attenuator 364 and a variable phase shifter 365 which adjust the amplitude of sub-signal 363, and phase shift sub-signal 363, respectively, to generate a corresponding phase-shifted sub-signal 366. Corresponding to each incoming signal dividing network 362 is a combining network 367 which combines one phase-shifted sub-signal 366 corresponding to each incoming signal dividing network 362 to generate a combined phase-shifted sub-signal 368 corresponding to one of the feed antennas 377. The combined phase-shifted sub-signals 368 are received from combining networks 367 by an input hybrid matrix 369, which generates hybrid phase-shifted sub-signals 370. Each hybrid phase-shifted sub-signal 370 corresponds to one of the feed antennas 377. Each hybrid phase-shifted sub-signal 370 passes through redundancy input switch matrix 371 and is provided to a corresponding fixed-amplitude amplifier 372 which amplifies the corresponding hybrid phase-shifted sub-signal 370 to generate an amplified hybrid phase-shifted sub-signal 373. Amplified hybrid phase-shifted sub-signals 373 then pass through redundancy output switch matrix 374 and are received by an output hybrid matrix 375, which generates amplified phase-shifted sub-signals 376, which are provided to corresponding feed antennas 377. Feed antennas 377 together illuminate a non-focused reflector (not illustrated) to generate a plurality of defocused beams.

Figure 4:
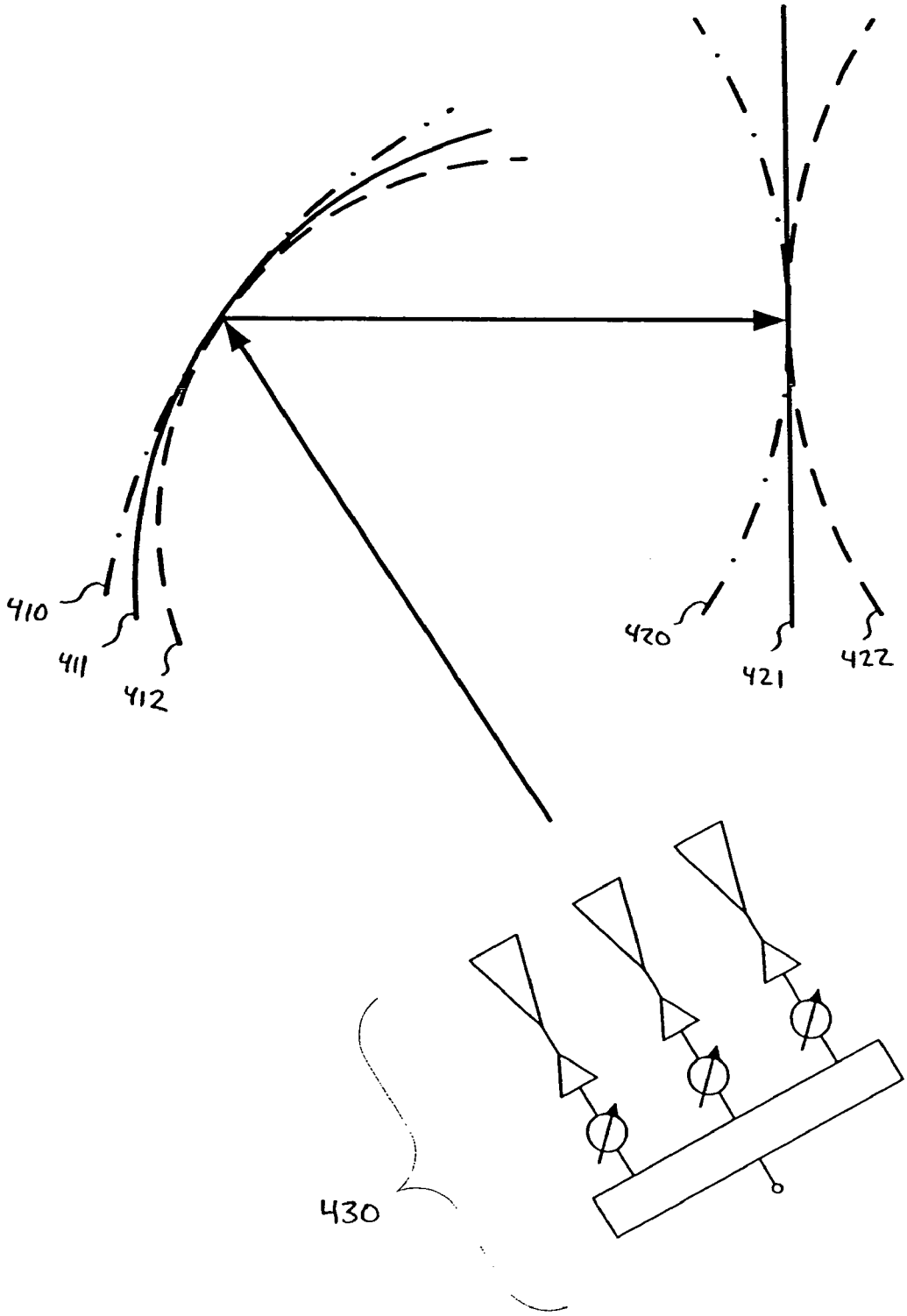
FIG. 4 illustrates the effect of the curvature of a reflector of an antenna system according to one aspect of the present invention.

Turning to FIG. 4, the curvature of a reflector of an antenna system according to various embodiments of the present invention is illustrated in greater detail. FIG. 4 illustrates a feed array 430 illuminating three different reflectors 410, 411 and 412. Feed array 430 is disposed in the focal plane (not shown) of all three reflectors 410, 411 and 412, although the angles in FIG. 4 have been exaggerated for clarity. Reflector 411 is a parabolic reflector. Accordingly, the corresponding wavefront 421 in the aperture plane of reflector 411 has a uniform phase. Reflector 410 has been "opened up" with respect to parabolic reflector 411 (i.e., the curvature of reflector 410 is less than that of reflector 411) such that the corresponding wavefront 420 in the aperture plane of reflector 410 has a quadratic phase distribution. A quadratic phase distribution significantly broadens the one or more beams formed by reflector 410, reducing the number of feed elements required to perform the necessary beam configurations by a factor of 4. Similarly, reflector 412 has been "closed in" with respect to parabolic reflector 411 (i.e., the curvature of reflector 411 is greater than that of reflector 411) such that the corresponding wavefront 422 in the aperture plane of reflector 412 has a quadratic phase distribution.

While the non-parabolic reflectors 410 and 412 in FIG. 4 have been illustrated as possessing a curvature for generating a quadratic phase distribution in a wavefront at their respective aperture planes, the scope of the present invention is not limited to such an arrangement. Rather, the present invention has application to reflectors with any non-parabolic curvature to generate one or more de-focused beams.

While due to the constraints imposed by schematic diagrams the feed arrays in the foregoing exemplary embodiments have been illustrated as including feed antennas arranged in a linear fashion, the scope of the present invention is not limited to such an arrangement. Rather, as will be apparent to one of skill in the art, the present invention has application to antenna systems in which the feed arrays include feed antennas in any arrangement. For example, as illustrated in greater detail with respect to FIGS. 5A and 5B, below, a feed array of the present invention may be arranged as a two-dimensional array.

Figure 5A:
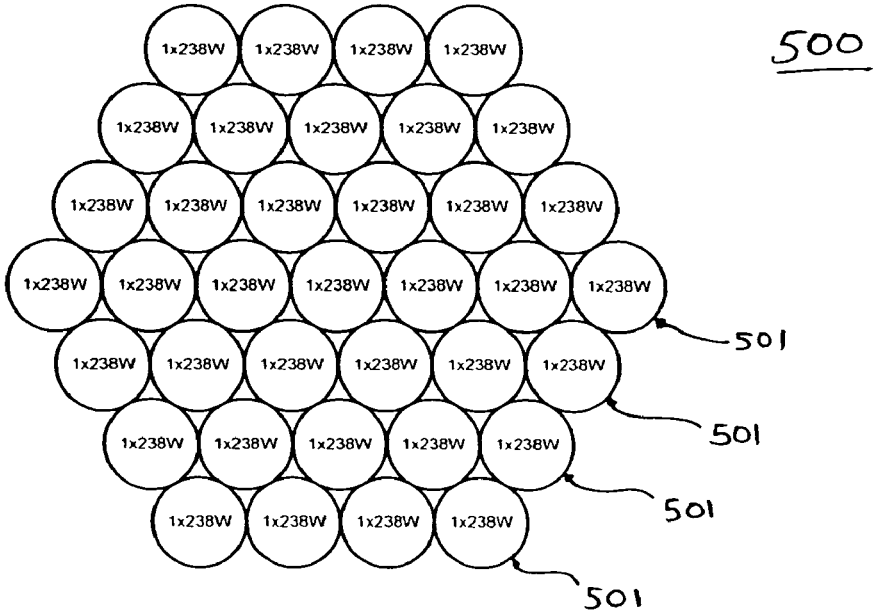
FIGS. 5A and 5B illustrate various arrangements of feed arrays according to various aspects of the present invention.
Figure 5B:
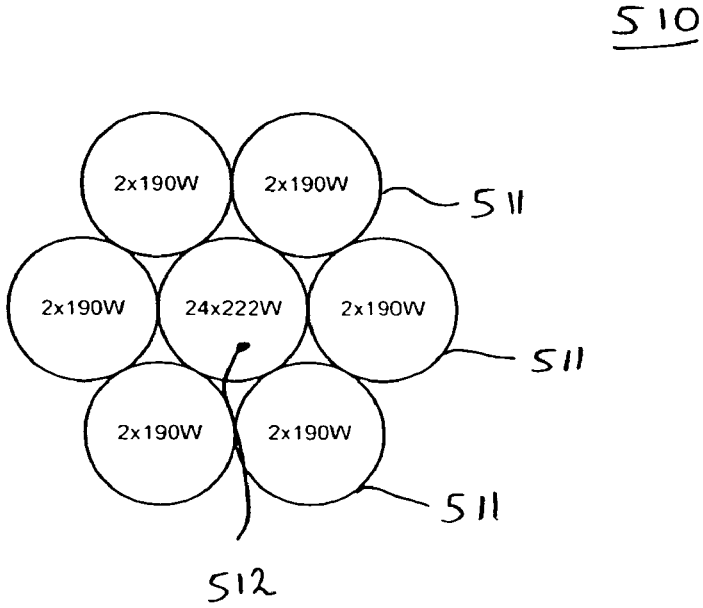

FIG. 5A illustrates the arrangement of a feed array 500 suitable for use in a HIEO satellite according to one aspect of the present invention. Feed array 500 includes 37 feed antennas 501, each of which has the same amplitude of 238 W. The uniform distribution of amplitude between the large number of feed antennas 501 provides the extensive on-orbit configurability need to compensate for the continual yawing of a HIEO satellite. FIG. 5B, by way of contrast, illustrates a feed array 510 including 7 feed antennas 511 and 512. Inner feed antenna 512 has a much larger amplitude (i.e., 5,328 W) than the outer feed antennas 511 (i.e., 380 W). The amplitudes of feed antennas 511 and 512 are, as in FIG. 5A, fixed amplitudes. This distribution of power among the feed antennas, in which the outer feed antennas 512 have about a −11.5 dB taper relative to central feed antenna 511, is suitable for use in a GEO satellite, in which the required on-orbit configurability is not as extensive as in a HIEO satellite.

Figure 6:
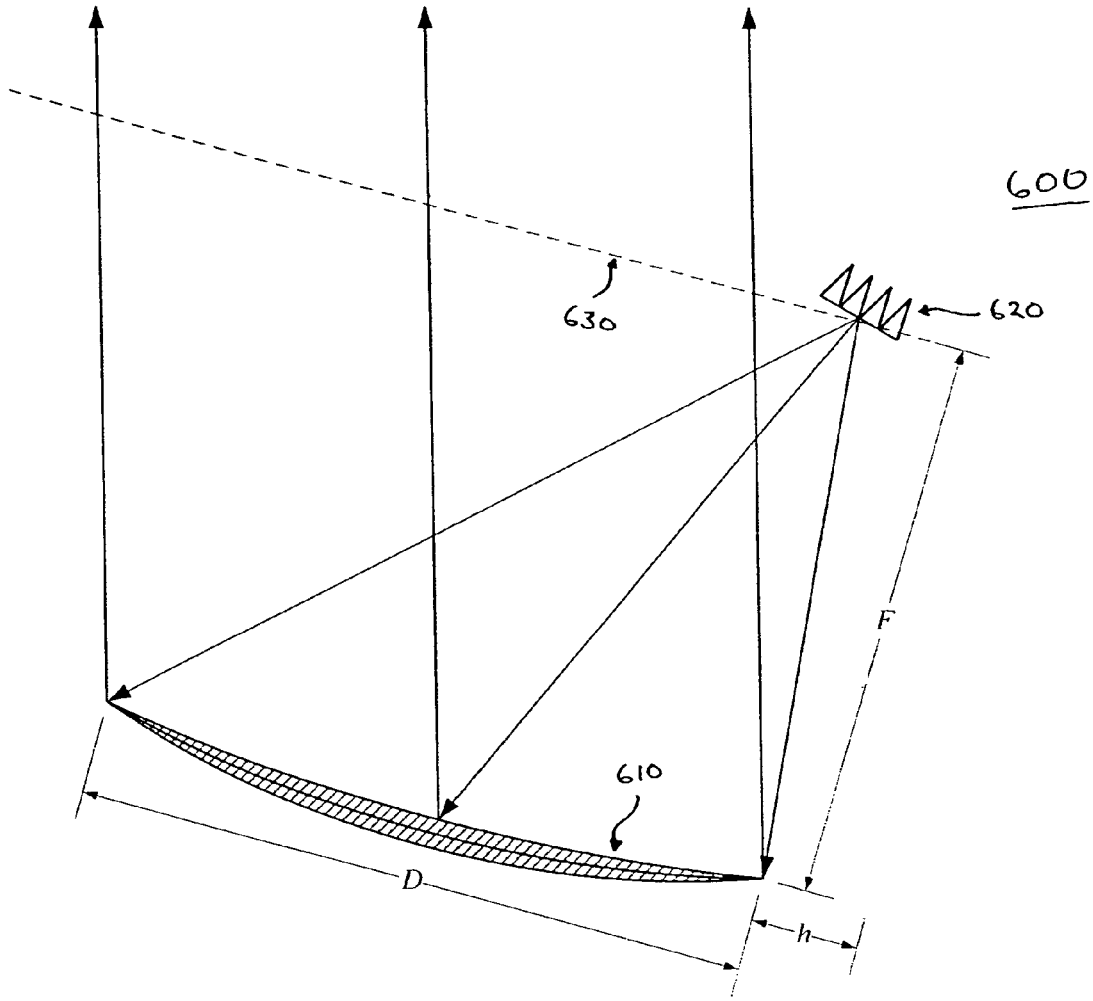
FIG. 6 illustrates the geometry of an antenna system according to one aspect of the present invention.

Turning to FIG. 6, the geometry of an antenna system according to one embodiment of the present invention is illustrated. Antenna system 600 includes non-parabolic reflector 610 and feed array 620 disposed in the focal plane 630 of reflector 610. Reflector 610 has a diameter D. Focal plane 630 is located a focal distance F from reflector 610. Feed array 620 is offset a height h from the edge of reflector 610. According to one embodiment, to minimize scan loss, reflector 610 has a diameter D of 12.0 m and a focal distance F of 8.4 m, providing a moderate F/D ratio of about 0.7.

An antenna system of the present invention utilizes phase-only synthesis to configure (e.g., steer, shape, rotate, etc.) the one or more beams that it generates. For example, according to one experimental embodiment of the present invention, an antenna system of the present invention was mathematically modeled to illustrate the capability of phase-only synthesis to provide yaw compensation for a HIEO satellite with 50° of inclination and 12 hours of coverage over the continental United States ("CONUS"). The antenna system of the present exemplary embodiment included 37 feed antennas with 0.24 m apertures and equal amplitudes of 238 W illuminating a 12.0 m non-parabolic reflector with a left-handed circularly polarized ("LHCP") signal in the S-Band (i.e. 2320.0 to 2332.5 MHz).

Figure 7:
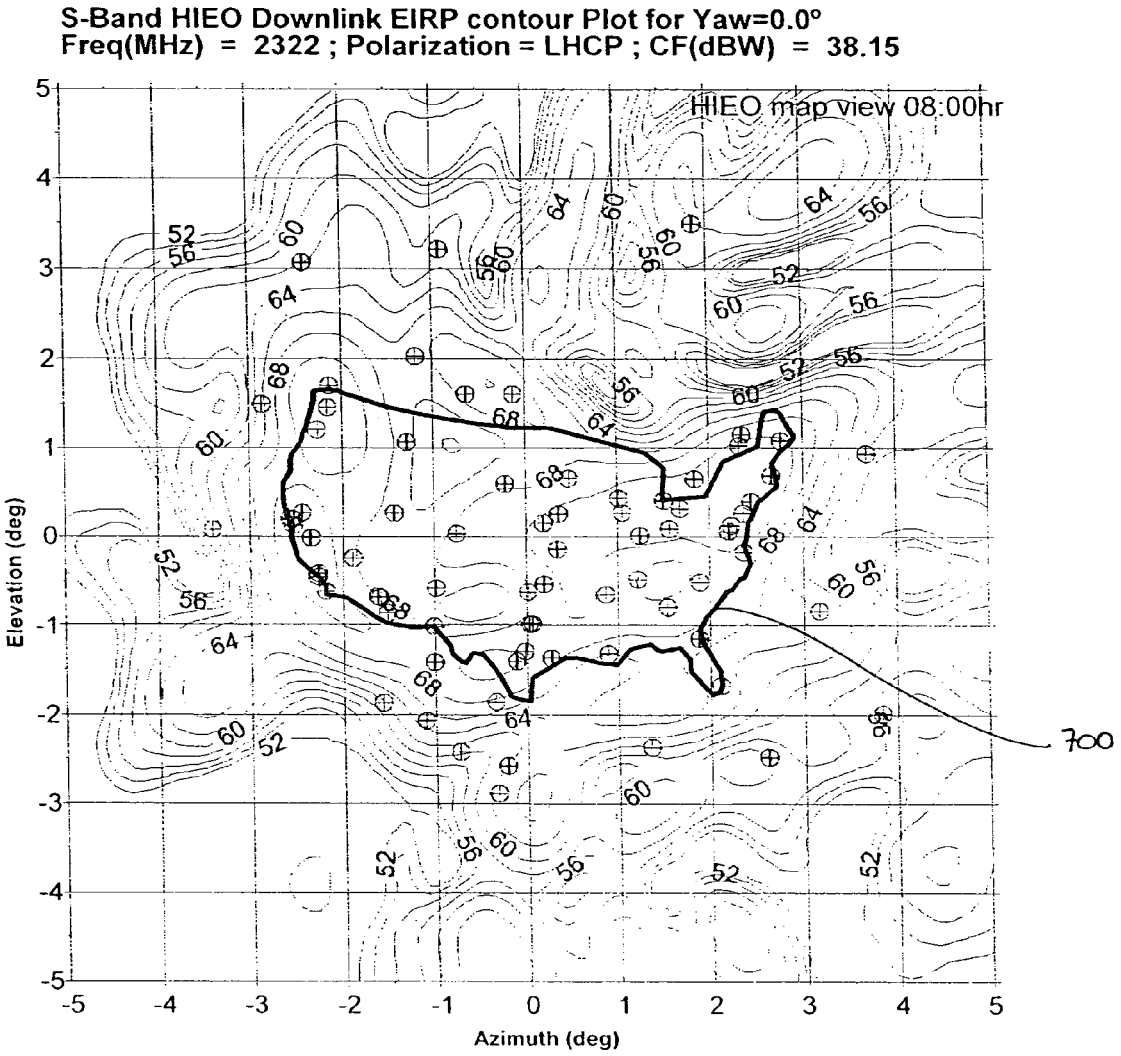
FIGS. 7 to 9 depict EIRP contour plots at for an antenna system on a HIEO satellite at various angles of yaw according to various aspects of the present invention.
Figure 8:
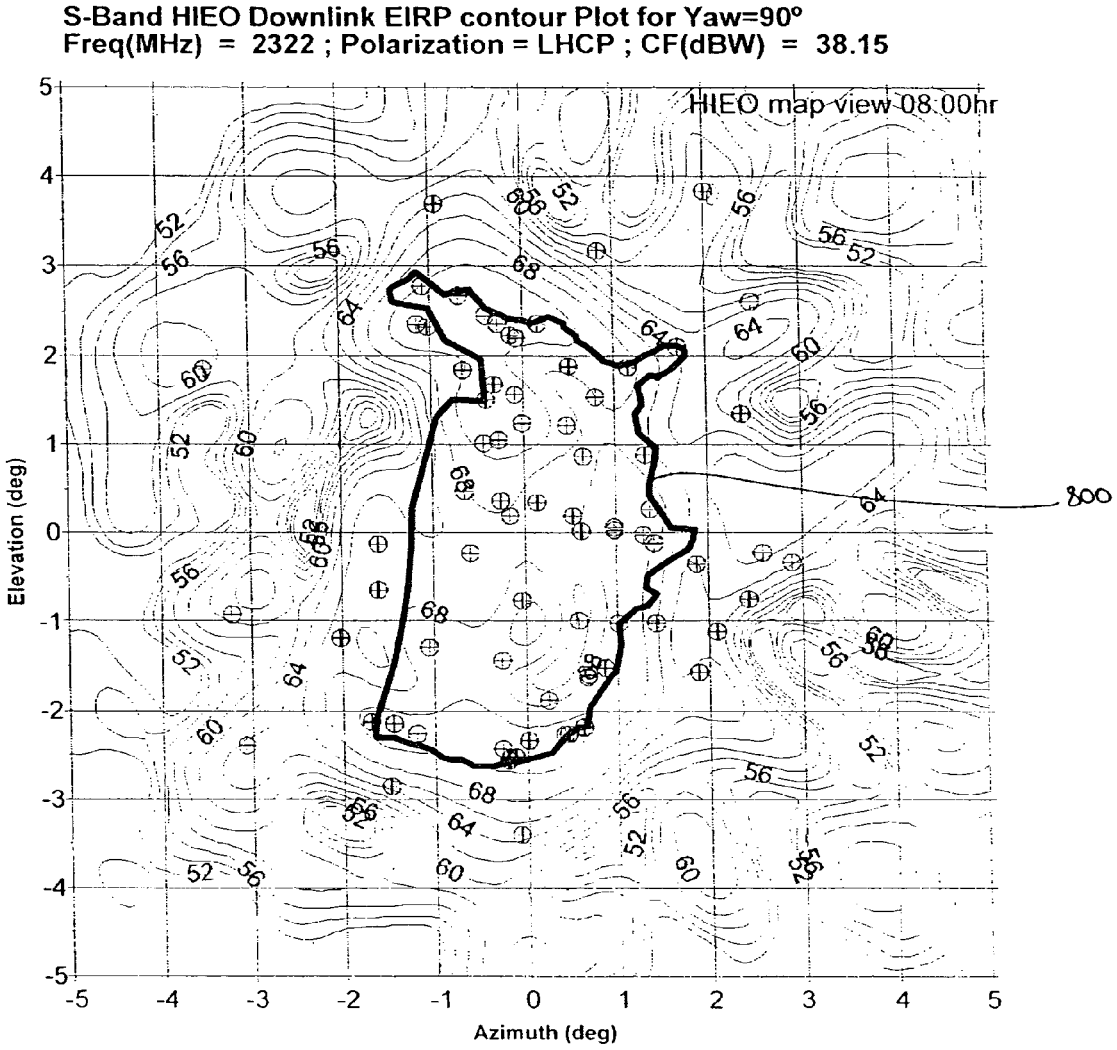
Figure 9:
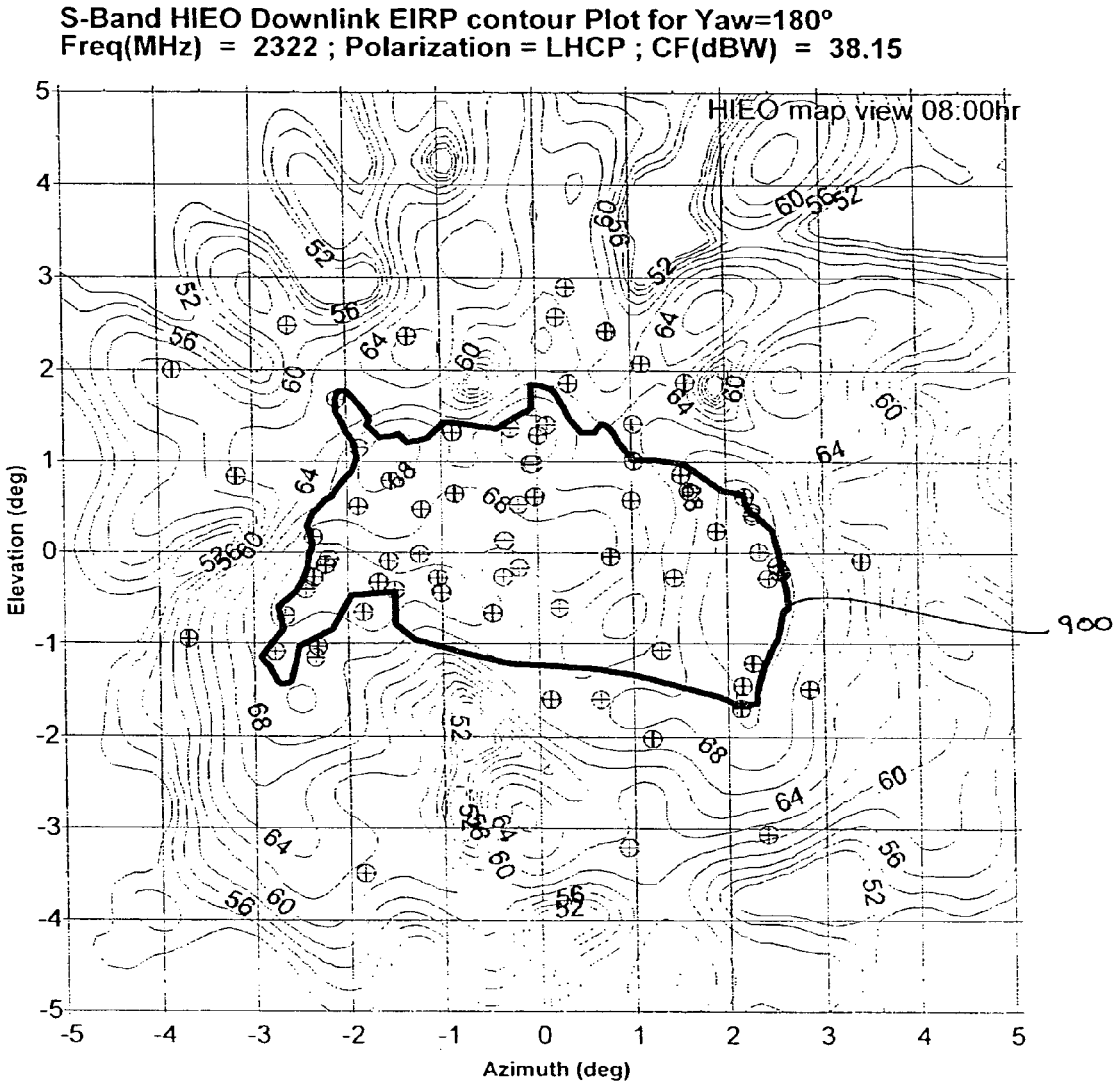

FIGS. 7 to 9 illustrate the Effective isotropically-radiated power ("EIRP") contour plots for this exemplary embodiment at each of 0°, 90° and 180° of yaw when the satellite is at apogee (i.e., 08:00 hr). As can be seen with reference to FIG. 7, the antenna system is able to generate a beam providing an EIRP of well over 60 dB for the CONUS 700 at 0° yaw. When the satellite on which the antenna system is yawed by 90°, the antenna system is able to compensate by reshaping the beam using phase-only synthesis, as can be seen with reference to FIG. 8, in which the CONUS 800 at 90° yaw is still provided with an EIRP of well over 60 dB. Even as the satellite yaws to 180°, the antenna system is able to compensate using phase-only synthesis, as can be seen with reference to FIG. 9, in which the CONUS 900 at 180° yaw is still provided with an EIRP of well over 60 dB. The phase-only synthesis allows the beam to cover the CONUS more efficiently, since less spill-over energy is expended outside of the desired coverage area.

Table 2, below, illustrates the phase delays introduced by the variable phase shifters (i.e., phase-only synthesis) at apogee for each of the 37 feed antennas in the antenna of the present exemplary embodiment at each of 0°, 45°, 90°, 135° and 180° of yaw.

TABLE 2

| Element | Amplitude (dB) | Phase (deg) Yaw = 0° | Yaw = 45° | Yaw = 90° | Yaw = 135° | Yaw = 180° |
|---|---|---|---|---|---|---|
| 1 | −15.682 | 38.13 | −130.61 | 39.97 | −7.61 | −139.03 |
| 2 | −15.682 | −75.79 | −137.26 | 43.93 | −10.03 | −137.31 |
| 3 | −15.682 | −69.34 | 118.29 | −2.44 | 45.42 | 128.59 |
| 4 | −15.682 | 137.46 | 60.32 | −69.82 | −125.82 | −78.70 |
| 5 | −15.682 | 31.59 | −114.74 | −37.07 | 13.57 | −68.28 |
| 6 | −15.682 | 1.54 | −84.21 | 42.36 | −14.40 | −75.49 |
| 7 | −15.682 | −80.41 | 52.74 | 36.52 | −16.50 | 37.54 |
| 8 | −15.682 | −99.35 | 53.42 | −28.23 | −34.41 | −44.94 |
| 9 | −15.682 | −64.66 | 40.92 | −86.30 | −106.57 | 55.70 |
| 10 | −15.682 | 57.14 | −10.03 | −116.74 | 72.36 | −16.28 |
| 11 | −15.682 | 6.02 | −35.24 | −41.61 | 37.05 | −9.67 |
| 12 | −15.682 | −10.99 | −27.02 | −34.74 | 4.36 | −6.83 |
| 13 | −15.682 | −49.35 | 62.48 | −14.13 | −27.34 | 30.36 |
| 14 | −15.682 | −11.21 | 14.07 | −82.95 | −59.50 | 48.92 |
| 15 | −15.682 | 14.71 | 42.09 | −66.11 | −86.96 | 49.14 |
| 16 | −15.682 | −9.48 | 28.60 | −138.05 | 3.94 | 42.76 |
| 17 | −15.682 | 28.60 | −9.39 | −99.45 | −18.46 | 44.99 |
| 18 | −15.682 | −60.13 | −37.00 | 19.13 | 4.09 | 25.88 |
| 19 | −15.682 | 0.00 | 0.00 | 0.00 | 0.00 | 0.00 |
| 20 | −15.682 | −18.24 | −29.81 | −41.21 | 12.48 | 74.54 |
| 21 | −15.682 | −19.91 | −15.27 | −80.82 | −50.68 | 93.32 |
| 22 | −15.682 | −48.97 | −28.49 | −23.22 | −72.02 | 100.00 |
| 23 | −15.682 | −0.76 | 68.98 | −41.66 | −105.08 | 112.61 |
| 24 | −15.682 | −27.90 | −8.66 | −11.18 | −37.42 | 41.82 |
| 25 | −15.682 | −35.17 | −16.50 | −59.59 | −16.33 | 46.29 |
| 26 | −15.682 | −45.42 | −42.80 | −44.10 | 27.92 | 35.01 |
| 27 | −15.682 | −49.69 | −38.70 | −72.44 | 65.35 | 93.72 |
| 28 | −15.682 | −48.87 | −10.91 | −136.85 | 42.61 | 130.65 |
| 29 | −15.682 | −38.23 | 47.72 | 0.55 | −84.06 | 103.51 |
| 30 | −15.682 | −63.62 | 18.65 | 29.36 | −3.18 | −26.05 |
| 31 | −15.682 | −86.30 | −68.49 | 35.61 | 57.13 | −10.98 |
| 32 | −15.682 | −93.65 | −84.96 | −35.66 | 66.45 | 80.58 |
| 33 | −15.682 | −84.76 | −109.54 | −113.40 | 105.76 | 131.26 |
| 34 | −15.682 | −144.28 | −2.78 | 21.94 | −13.95 | 128.96 |
| 35 | −15.682 | −113.18 | −5.15 | 44.96 | 45.67 | −30.04 |
| 36 | −15.682 | −131.69 | −78.27 | 1.83 | 122.25 | 14.05 |
| 37 | −15.682 | −133.00 | −136.45 | −65.61 | 83.58 | 84.16 |

As can be seen with reference to Table 2, the amplitude of each feed antenna was a constant −15.682 dB (supplied by a single 238 W fixed-amplitude amplifier per feed antenna). The beam configuration was accordingly provided solely by the phase shift introduced in each beamlet by the variable phase shifters.

Figure 10A:
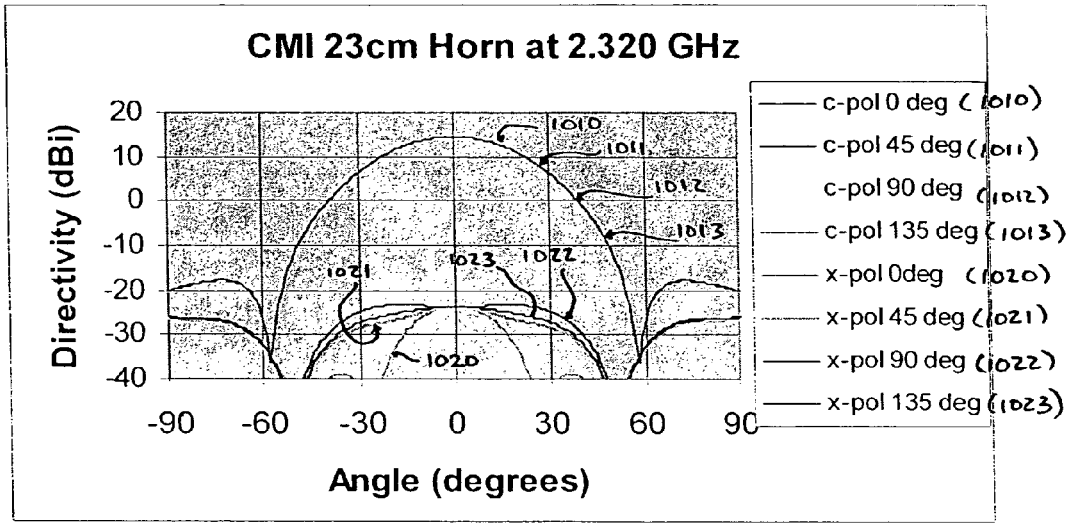
FIGS. 10A and 10B illustrate an advantage in cross-polar isolation enjoyed by an antenna system according to one aspect of the present invention.
Figure 10B:
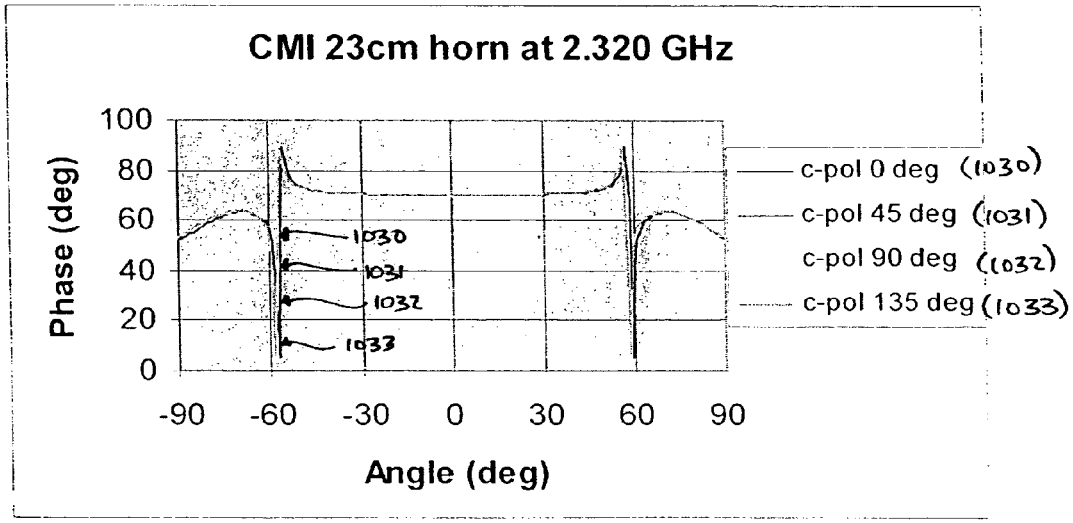

Turning to FIGS. 10A and 10B, an additional performance advantage of an antenna system according to one embodiment of the present invention is illustrated. FIG. 10B illustrates the phase distribution of the primary pattern of an antenna system according to one embodiment of the present invention, at each of 0° (1030), 45° yaw (1031), 90° yaw (1032) and 135° yaw (1033). FIG. 10A is a graph illustrating the cross-polar isolation of the primary pattern of the same antenna system. Over the angle subtended by the feed array (i.e., from about −25° to about 25°), the difference between cross-polar directivity (1020 at 0° yaw, 1021 at 45° yaw, 1022 at 90° yaw, and 1023 at 135° yaw) and the co-polar directivity (1010 at 0° yaw, 1011 at 45° yaw, 1012 at 90° yaw, and 1013 at 135° yaw) in the primary pattern is greater than 33 dB. This cross-polar isolation of greater than 33 dB in the primary pattern permits an antenna system of the present invention to enjoy high gain and directivity, regardless of the phase distribution of the feed array.

Figure 11:
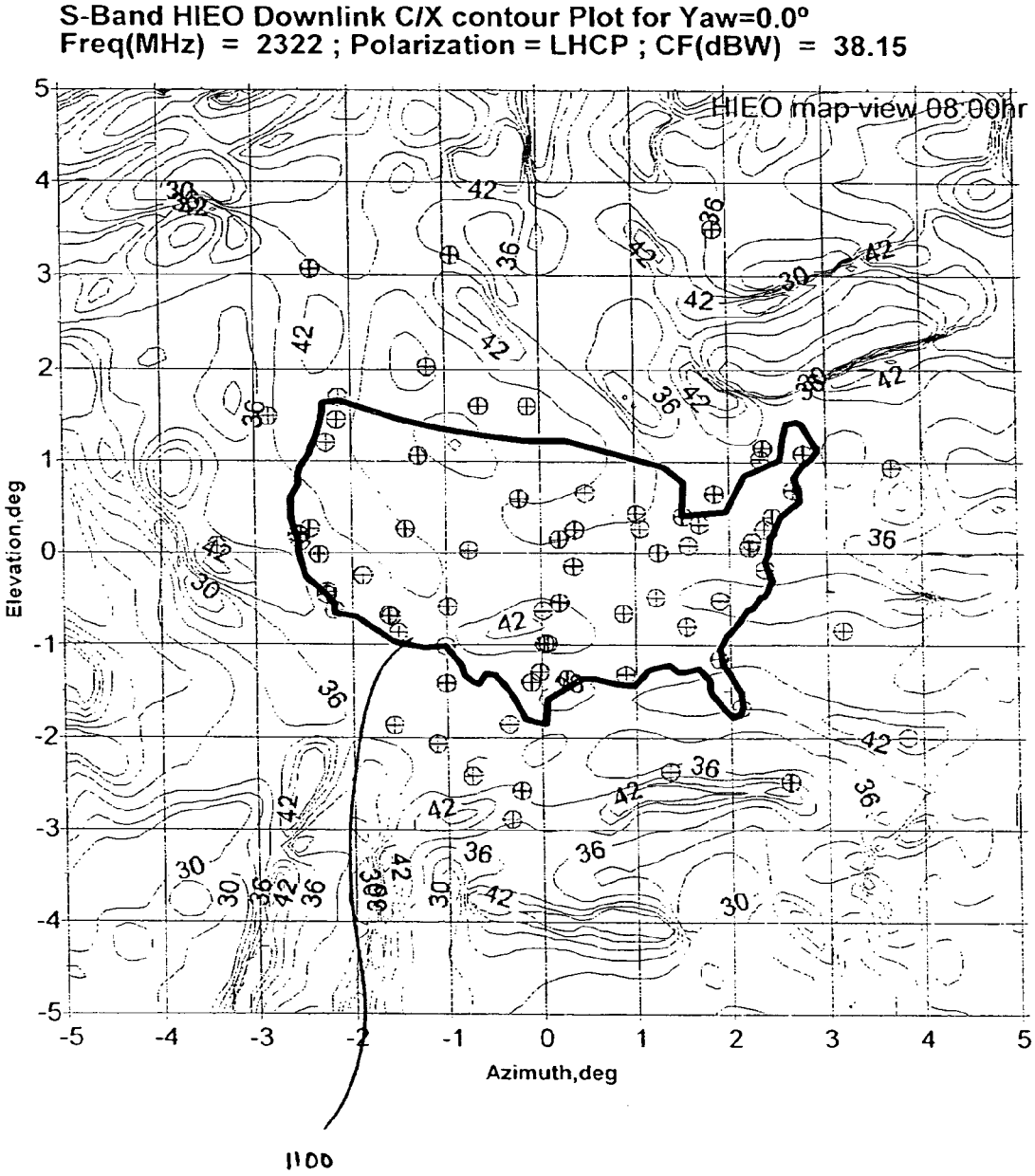
FIG. 11 depicts a cross-polar isolation contour plot for an antenna system on a HIEO satellite according to one aspect of the present invention.

Turning to FIG. 11, a cross-polar isolation contour plot for this exemplary embodiment at 0° of yaw when the satellite is at apogee (i.e., 08:00 hr) is illustrated. As can be seen with reference to FIG. 11, the antenna system is able to generate a beam providing better than 30 dB cross-polar isolation for the CONUS 1100.

According to another experimental embodiment of the present invention, an antenna system of the present invention was mathematically modeled to illustrate the capability of phase-only synthesis to provide on-orbit beam reconfiguration for a GEO satellite with an orbital arc of 94° to 98° west. The antenna system of the present exemplary embodiment included 7 feed antennas with 0.37 m apertures and a fixed power distribution (i.e., a central feed of 24×222 W and 6 outer feeds of 2×190 W) illuminating a 12.0 m non-parabolic shaped reflector with a left-handed circularly polarized ("LHCP") signal in the S-Band (i.e., 2320.0 to 2332.5 MHz). The primary pattern cross-polar isolation was shown to be better than 40 dB, with a feed efficiency of greater than 85% and a multipaction margin for 9 KW peak power of 6.5 dB.

Figure 12:
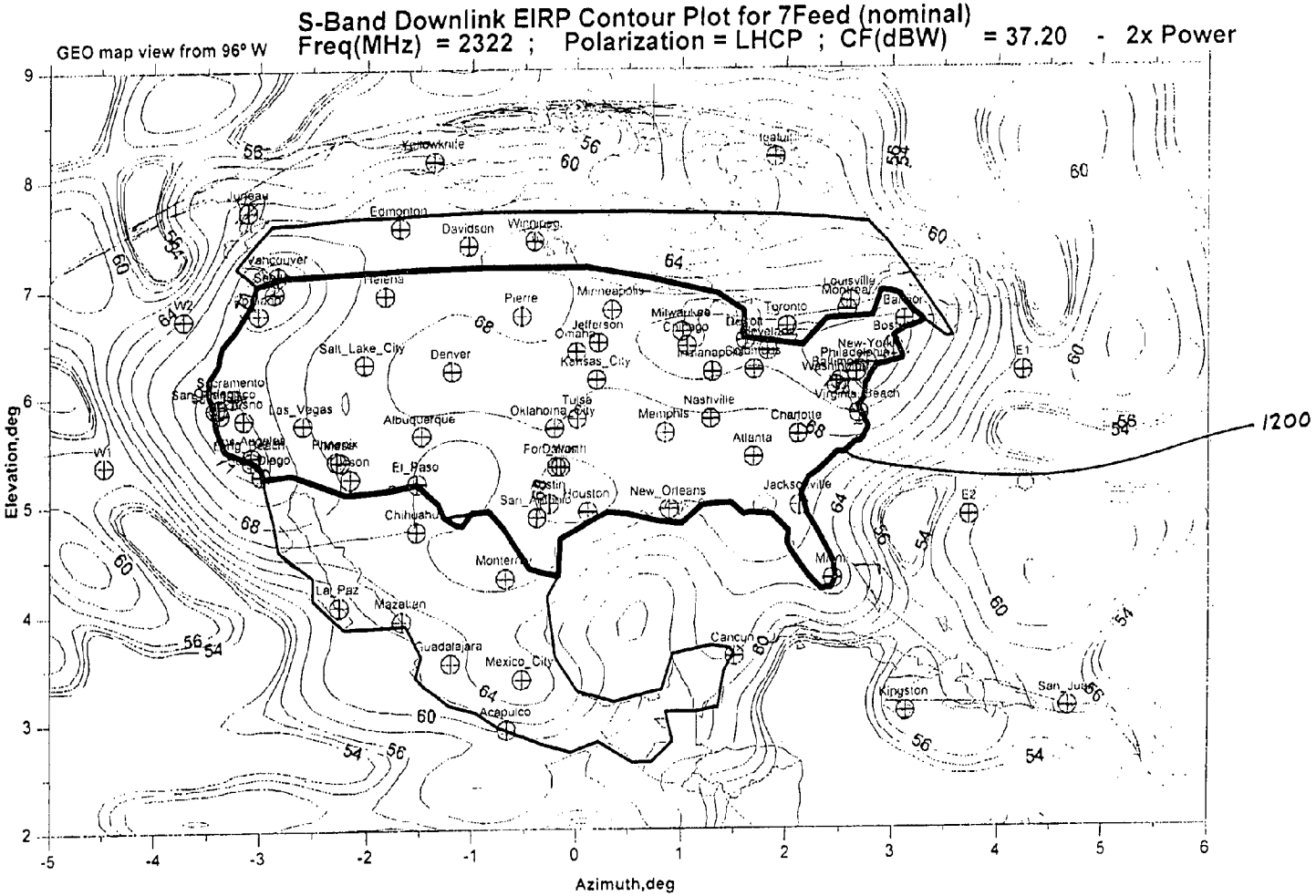
FIGS. 12 and 13 depict EIRP contour plots for an antenna system on a GEO satellite in various configurations according to various aspects of the present invention.
Figure 13:
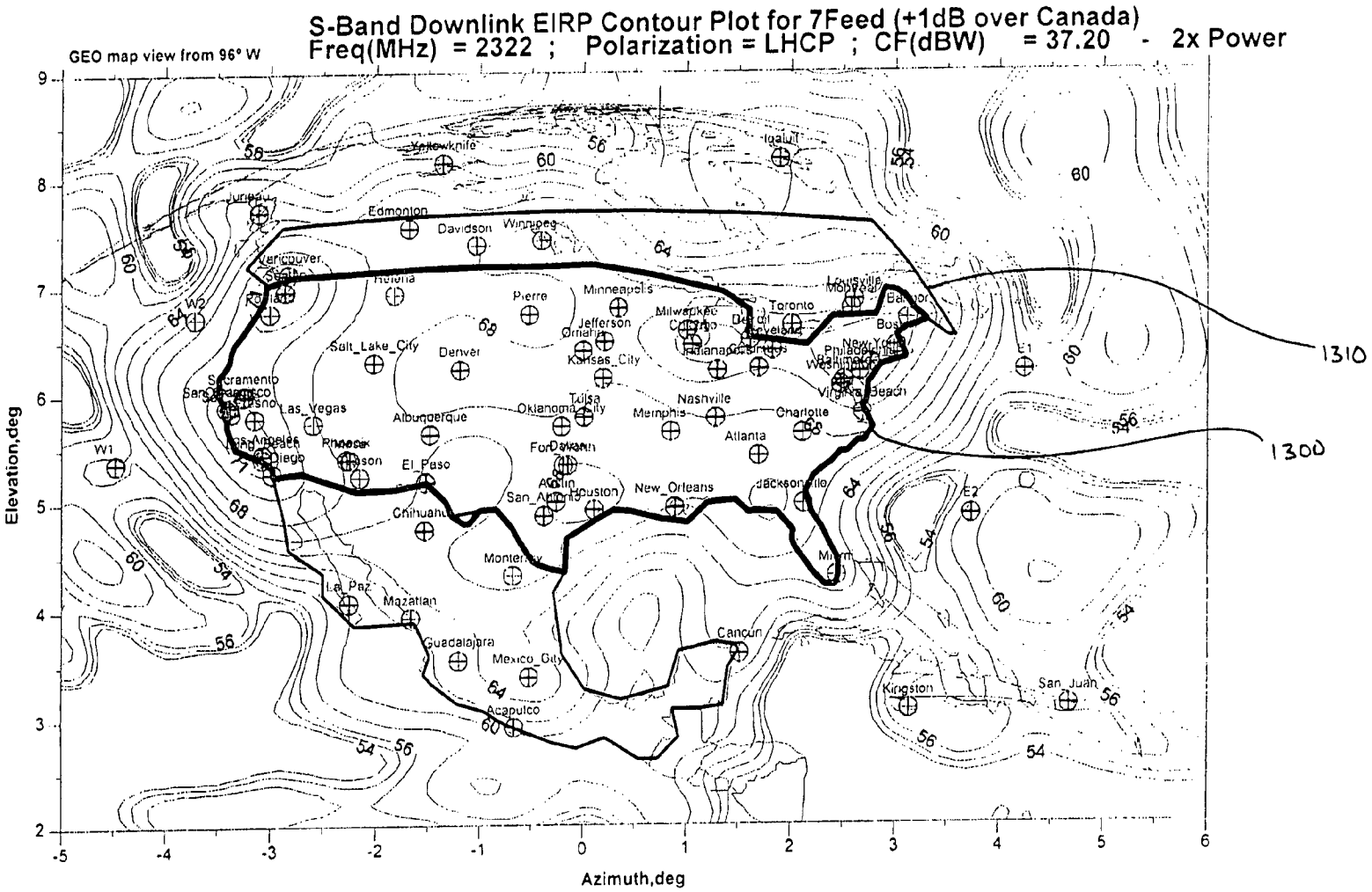

FIGS. 12 and 13 illustrate the EIRP contour plots for this exemplary embodiment at 96° W for a baseline configuration and for a configuration in which an additional 1 dB more EIRP is provided to Canada. As can be seen with reference to FIG. 12, the antenna system is able to generate a beam providing an EIRP of well over 64 dB for the CONUS 1200. Turning to FIG. 13, through phase-only synthesis, the antenna system is able to reconfigure the beam to provide an additional 1 dB of EIRP to Canada 1310 while still providing over 64 dB for the CONUS 1300.

Figure 14:
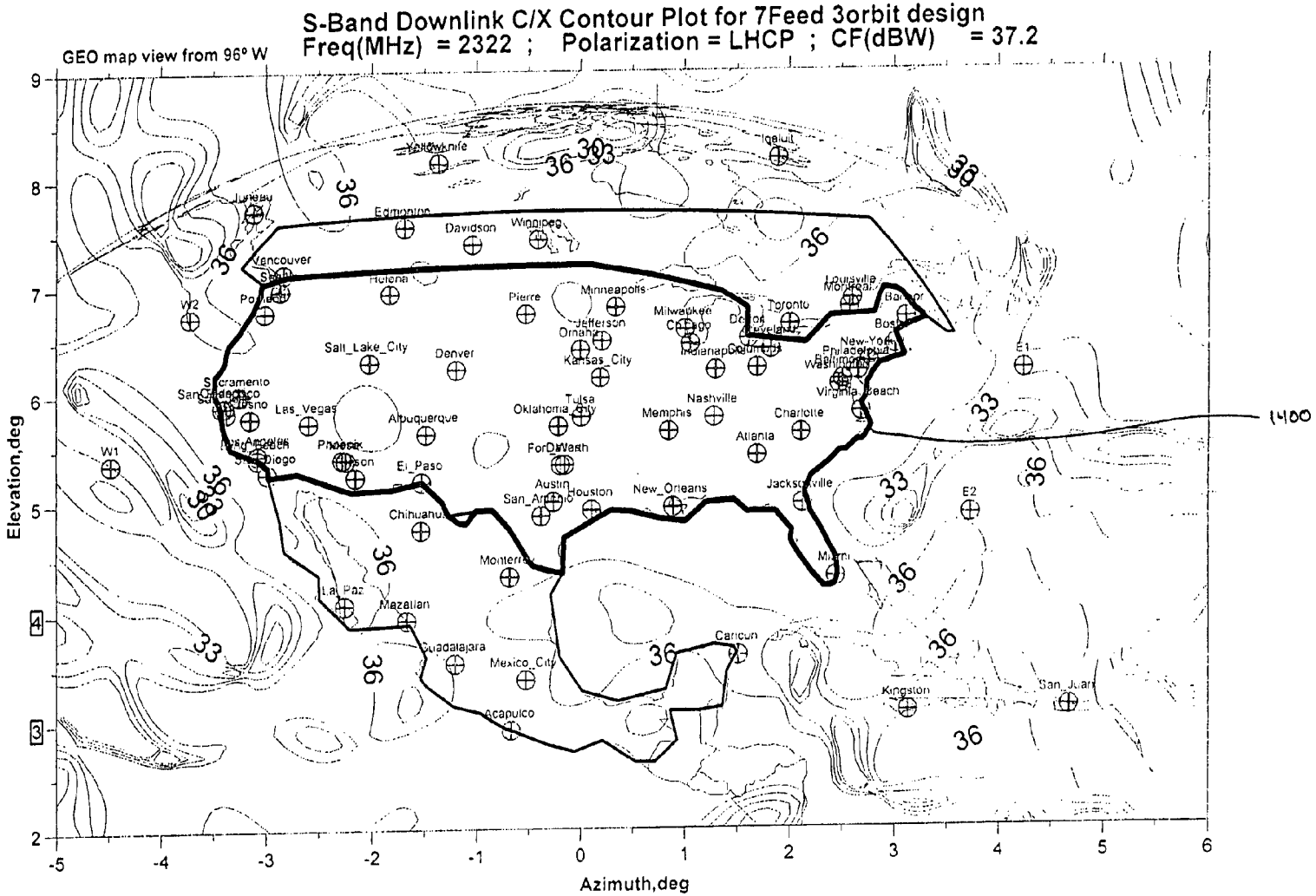
FIGS. 14 and 15 depict cross-polar isolation contour plots for an antenna system on a GEO satellite in various configurations according to various aspects of the present invention.
Figure 15:
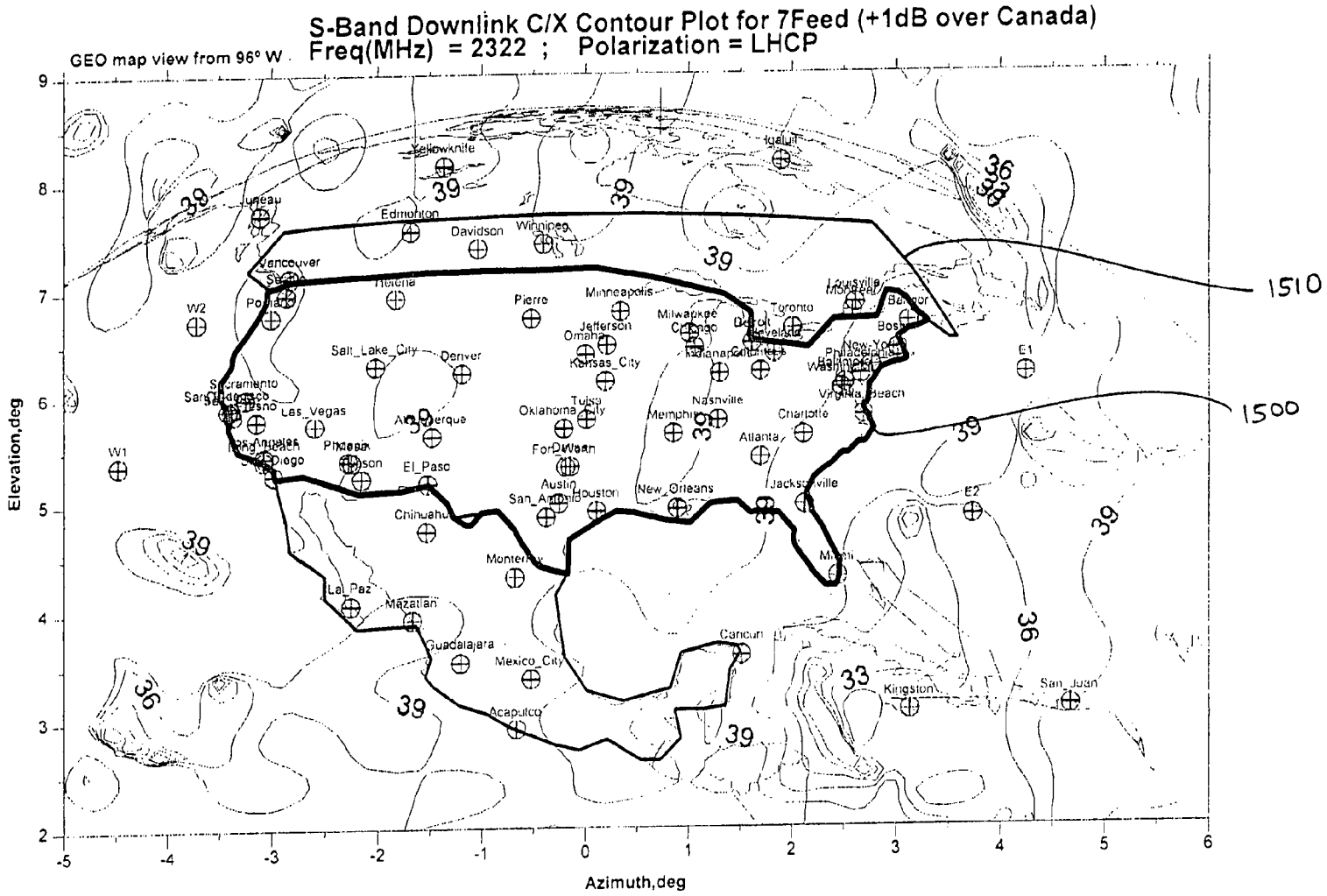

FIG. 14 illustrates a cross-polar isolation contour plot for the baseline configuration of this exemplary embodiment at 96° W. As can be seen with reference to FIG. 14, the antenna system is able to generate a beam providing a cross-polar isolation of better than 36 dB for substantially all of the CONUS 1400. Turning to FIG. 15, when the antenna system is reconfigured through phase-only synthesis to provide an additional 1 dB of EIRP to Canada 1510, the cross-polar isolation over the CONUS 1500 and substantially all of Canada 1510 remains better than 36 dB.

Table 3, below, illustrates the phase delays introduced by the variable phase shifters (i.e., phase-only synthesis) for each of the 7 feed antennas in the antenna system of the present exemplary embodiment in the baseline configuration and to provide an additional 1° of EIRP TO Canada.

TABLE 3

| Element | Amplitude (dB) | Phase (deg) Baseline | Phase (deg) +1 dB over Canada |
|---|---|---|---|
| 1 | −1.551 | 0.0 | 0.0 |
| 2 | −13.006 | 0.0 | 3.77 |
| 3 | −13.006 | 0.0 | −1.55 |
| 4 | −13.006 | 0.0 | −1.31 |
| 5 | −13.006 | 0.0 | −2.23 |
| 6 | −13.006 | 0.0 | −5.07 |
| 7 | −13.006 | 0.0 | −9.28 |

As can be seen with reference to Table 3, the amplitude of each feed antenna was kept constant, and the beam configuration was provided solely by the phase shift introduced in each beamlet by the variable phase shifters.

Figure 16:
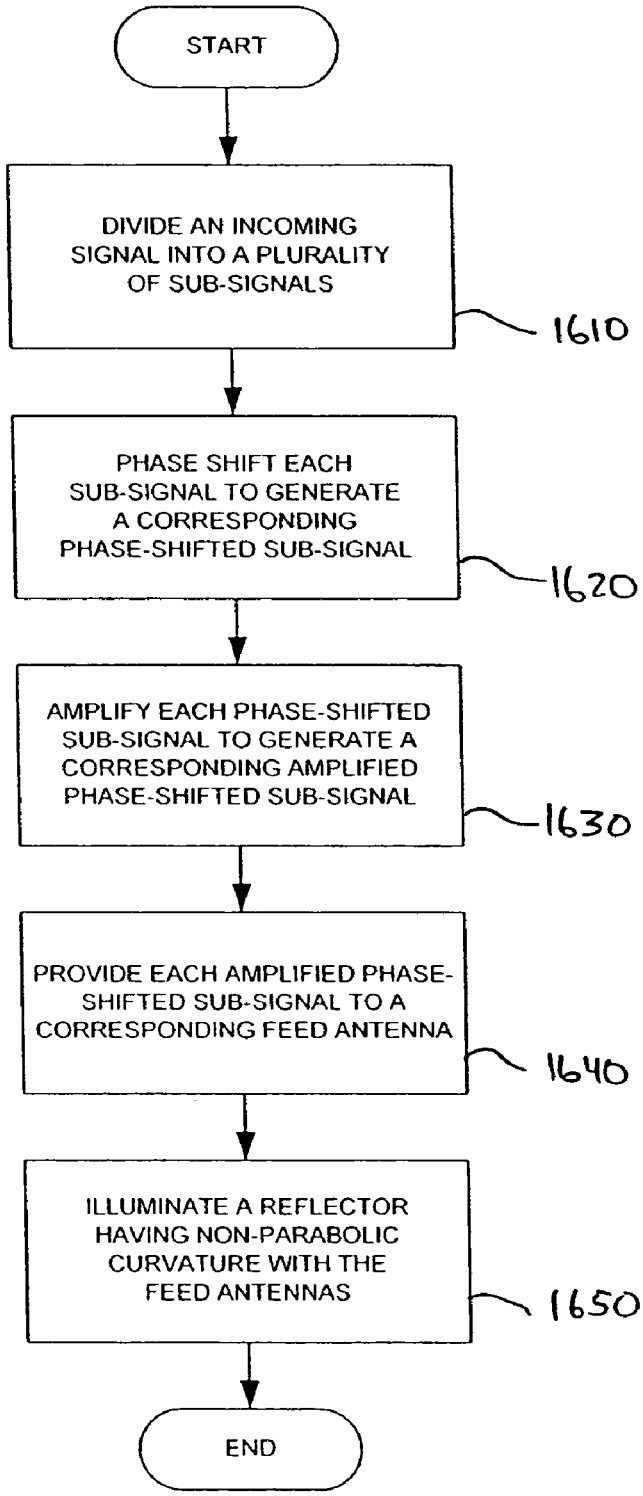
FIG. 16 is a flowchart depicting a method for generating and configuring at least one defocused beam according to another embodiment of the present invention.

FIG. 16 is a flowchart illustrating a method for generating and configuring at least one defocused beam using an antenna system with a non-parabolic reflector and an array of feed antennas according to one embodiment of the present invention. As is discussed in greater detail above, the array of feed antennas is disposed in the focal plane of the non-parabolic reflector. In step 1610, an incoming signal is divided into a plurality of sub signals using an incoming signal dividing network. Each sub-signal corresponds to one of the feed antennas in the feed array. In step 1620, each of the sub-signals is phase-shifted, using a variable phase shifter, to generate a corresponding phase-shifted sub-signal. In step 1630, each of the phase-shifted sub-signals is amplified by one or more amplifiers to generate an amplified phase-shifted sub-signal. As discussed in greater detail with respect to FIG. 2, above, in an embodiment in which more than one amplifier corresponds to each feed antenna, each phase-shifted sub-signal will first be divided by a corresponding pre-amp dividing network to generate a plurality of divided phase-shifted sub-signals, which, after amplification, will be combined in a combining network. In step 1640, each amplified phase-shifted sub-signal generated in step 1630 is provided to the corresponding feed antenna which, in step 1650, illuminates the non-parabolic reflector to generate at least one defocused beam.

While the present invention has been particularly described with reference to the various figures and embodiments, it should be understood that these are for illustration purposes only and should not be taken as limiting the scope of the invention. There may be many other ways to implement the invention. Many changes and modifications may be made to the invention, by one having ordinary skill in the art, without departing from the spirit and scope the invention.

What is claimed is:

1. An antenna system for generating and configuring at least one defocused beam, the antenna system comprising:

a reflector having a focal plane and a non-parabolic curvature that forms the at least one defocused beam;

a plurality of feed antennas that illuminate the reflector, each feed antenna being disposed in the focal plane of the reflector;

at least one incoming signal dividing network that divides at least one incoming signal into a plurality of sub-signals, each sub-signal corresponding to one of the plurality of feed antennas;

a plurality of variable phase shifters, each variable phase shifter receiving one of the plurality of sub-signals from the at least one incoming signal dividing network and phase shifting the one of the plurality of sub-signals to generate a corresponding phase-shifted sub-signal;

a plurality of fixed-amplitude amplifiers, at least one amplifier corresponding to each of the plurality of feed antennas, the at least one amplifier for each feed antenna amplifying the corresponding phase-shifted sub-signal to generate an amplified phase-shifted sub-signal which is provided to the corresponding feed antenna, wherein the curvature of the reflector creates a symmetrical quadratic phase-front in an aperture plane of the reflector.

2. The antenna system of claim 1, wherein at least two amplifiers correspond to each of the plurality of feed antennas, the antenna system further comprising:

a plurality of pre-amp dividing networks, each pre-amp dividing network corresponding to one of the plurality of phase-shifted sub-signals, each pre-amp dividing network dividing the corresponding phase-shifted sub-signal into a plurality of divided phase-shifted sub-signals and providing each divided phase-shifted sub-signal to a corresponding one of the at least two amplifiers; and a plurality of combining networks, each combining network corresponding to one of the plurality of pre-amp dividing networks, each combining network combining a plurality of amplified divided phase-shifted sub-signals received from the at least two amplifiers into a corresponding amplified phase-shifted sub-signal and providing the amplified phase-shifted sub-signal to the corresponding feed antenna.

3. The antenna system of claim 1, wherein the at least one incoming signal includes a plurality of incoming signals, and wherein the at least one incoming signal dividing network includes a corresponding plurality of incoming signal dividing networks, the antenna system further comprising:

a plurality of combining networks, each combining network corresponding to one of the plurality of incoming signal dividing networks, each combining network combining a corresponding plurality of the phase-shifted sub-signals received from a corresponding plurality of the variable phase-shifters to generate a combined phase-shifted sub-signal;

an input hybrid matrix that receives the plurality of combined phase-shifted sub-signals from the plurality of combining networks, generates a corresponding plurality of hybrid phase-shifted sub-signals, and provides each of the plurality of hybrid phase-shifted sub-signals to a corresponding one of the plurality of fixed-amplitude amplifiers which amplifies the hybrid phase-shifted sub-signal to generate a corresponding amplified hybrid phase-shifted sub-signal; and an output hybrid matrix that receives the amplified hybrid phase-shifted sub-signals from the plurality of fixed-amplitude amplifiers, generates a corresponding plurality of amplified phase-shifted sub-signals, and provides each amplified phase-shifted sub-signal to a corresponding one of the plurality of feed antennas.

4. The antenna system of claim 1, wherein the at least one amplifier corresponding to each of the plurality of feed antennas comprises a same number of amplifiers corresponding to each of the plurality of feed antennas.

5. The antenna system of claim 1, wherein each amplified phase-shifted sub-signal has a same amplitude as every other amplified phase-shifted sub-signal.

6. The antenna system of claim 1, wherein the plurality of variable phase shifters phase shift the plurality of sub-signals to modify a shape or a direction of the at least one defocused beam.

7. The antenna system of claim 1, wherein the plurality of feed antennas are arranged in an array in the focal plane of the reflector, and wherein the feed antennas disposed nearer a center of the array illuminate the reflector with higher amplitude signals than the feed antennas disposed farther from the center of the array.

8. The antenna system of claim 1, wherein the reflector includes a single-axis gimbal mechanism.

9. A satellite including the antenna system of claim 1, wherein the plurality of variable phase shifters phase shift the plurality of sub-signals to provide anti-yaw compensation for the at least one defocused beam.

10. A method for generating and configuring at least one defocused beam using an antenna system including a reflector having a non-parabolic curvature and a plurality of feed antennas disposed in a focal plane of the reflector, the method comprising the steps of:

dividing at least one incoming signal with at least one incoming signal dividing network into a plurality of sub-signals, each sub-signal corresponding to one of the plurality of feed antennas;

phase shifting the plurality of sub-signals with a plurality of variable phase shifters, each variable phase shifter receiving one of the plurality of sub-signals from the at least one incoming signal dividing network and phase shifting the one of the plurality of sub-signals to generate a corresponding phase-shifted sub-signal;

amplifying the plurality of phase-shifted sub-signals with a plurality of fixed-amplitude amplifiers, at least one amplifier corresponding to each of the plurality of feed antennas, the at least one amplifier for each feed antenna amplifying a corresponding phase-shifted sub-signal to generate an amplified phase-shifted sub-signal which is provided to the corresponding feed antenna; and illuminating the reflector with the plurality of feed antennas to generate the at least one defocused beam, wherein the curvature of the reflector creates a symmetrical quadratic phase-front in an aperture plane of the reflector.

11. The method of claim 10, wherein at least two amplifiers correspond to each of the plurality of feed antennas, the method further comprising the steps of:

dividing the corresponding phase-shifted sub-signal into a plurality of divided phase-shifted sub-signals in a plurality of pre-amp dividing networks, each pre-amp dividing network corresponding to one of the plurality of phase-shifted sub-signals;

providing each divided phase-shifted sub-signal to a corresponding one of the at least two amplifiers; and combining a plurality of amplified divided phase-shifted sub-signals received from the at least two amplifiers in a plurality of combining networks, each combining network corresponding to one of the plurality of pre-amp dividing networks and providing the amplified phase-shifted sub-signal to the corresponding feed antenna.

12. The method of claim 10, wherein the at least one incoming signal includes a plurality of incoming signals, and wherein the at least one incoming signal dividing network includes a corresponding plurality of incoming signal dividing networks, the method further comprising the steps of:

combining a corresponding plurality of the phase-shifted sub-signals received from a corresponding plurality of the variable phase-shifters with a plurality of combining networks to generate a combined phase-shifted sub-signal, each combining network corresponding to one of the plurality of incoming signal dividing networks;

providing the plurality of combined phase-shifted sub-signals from the plurality of combining networks to an input hybrid matrix which generates a corresponding plurality of hybrid phase-shifted sub-signals and provides each of the plurality of hybrid phase-shifted sub-signals to a corresponding one of the plurality of fixed-amplitude amplifiers which amplifies the hybrid phase-shifted sub-signal to generate a corresponding amplified hybrid phase-shifted sub-signal; and providing the amplified hybrid phase-shifted sub-signals to an output hybrid matrix which generates a corresponding plurality of amplified phase-shifted sub-signals and provides each amplified phase-shifted sub-signal to a corresponding one of the plurality of feed antennas.

13. The method of claim 10, wherein the at least one amplifier corresponding to each of the plurality of feed antennas comprises a same number of amplifiers corresponding to each of the plurality of feed antennas.

14. The method of claim 10, wherein each amplified phase-shifted sub-signal has a same amplitude as every other amplified phase-shifted sub-signal.

15. The method of claim 10, wherein the plurality of variable phase shifters phase shift the plurality of sub-signals to modify a shape or a direction of the at least one defocused beam.

16. The method of claim 10, wherein the plurality of feed antennas are arranged in an array in the focal plane of the reflector, and wherein the feed antennas disposed nearer a center of the array illuminate the reflector with higher amplitude signals than the feed antennas disposed farther from the center of the array.

17. The method of claim 10, wherein the reflector includes a single-axis gimbal mechanism.

18. A method for generating and configuring at least one defocused beam using an antenna system including a reflector having non-parabolic curvature and a plurality of feed antennas disposed in a focal plane of the reflector, the reflector including a single-axis gimbal mechanism, the method comprising the steps of:

dividing at least one incoming signal with at least one incoming signal dividing network into a plurality of sub-signals, each sub-signal corresponding to one of the plurality of feed antennas;

phase shifting the plurality of sub-signals with a plurality of variable phase shifters, each variable phase shifter receiving one of the plurality of sub-signals from the at least one incoming signal dividing network and phase shifting the one of the plurality of sub-signals to generate a corresponding phase-shifted sub-signal;

amplifying the plurality of phase-shifted sub-signals with a plurality of fixed-amplitude amplifiers, at least one amplifier corresponding to each of the plurality of feed antennas, the at least one amplifier for each feed antenna amplifying a corresponding phase-shifted sub-signal to generate an amplified phase-shifted sub-signal which is provided to the corresponding feed antenna; and illuminating the reflector with the plurality of feed antennas to generate the at least one defocused beam, wherein the plurality of variable phase shifters phase shift the plurality of sub-signals to compensate for a yawing motion of the antenna system, wherein the single-axis gimbal mechanism of the reflector gimbals the reflector to compensate for a rolling motion of the antenna system, and wherein the curvature of the reflector creates a symmetrical quadratic phase-front in an aperture plane of the reflector.

* * * * *